US006966265B2

(12) United States Patent
Ronn et al.

(10) Patent No.: US 6,966,265 B2
(45) Date of Patent: Nov. 22, 2005

(54) UNIT OF AMMUNITION WITH ONE OR MORE WARHEAD CASINGS

(75) Inventors: Torsten Ronn, Karlskoga (SE); Nils Johansson, Karlskoga (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/312,510

(22) PCT Filed: Jun. 20, 2001

(86) PCT No.: PCT/SE01/01403

§ 371 (c)(1),
(2), (4) Date: Jul. 11, 2003

(87) PCT Pub. No.: WO02/03016

PCT Pub. Date: Jan. 10, 2002

(65) Prior Publication Data

US 2004/0074413 A1 Apr. 22, 2004

(30) Foreign Application Priority Data

Jul. 3, 2000 (SE) ..... 0024885

(51) Int. Cl.[7] ..... F42B 12/20; F42B 12/32
(52) U.S. Cl. ..... 102/514; 102/389; 102/492
(58) Field of Search ..... 102/514, 478, 102/489, 492, 494, 393, 394, 496, 497, 389

(56) References Cited

U.S. PATENT DOCUMENTS 3,093,072 A * 6/1963 Pigman ..... 102/393
3,949,674 A 4/1976 Talley
3,981,242 A * 9/1976 Shurtleff ..... 102/454
4,036,140 A * 7/1977 Korr et al. ..... 102/438
4,312,274 A * 1/1982 Zernow ..... 102/493
4,488,489 A * 12/1984 Schoffl ..... 102/489
4,676,167 A * 6/1987 Huber et al. ..... 102/393
4,714,020 A * 12/1987 Hertsgaard et al. ..... 102/351
4,750,403 A * 6/1988 Huber et al. ..... 89/1.51
4,750,423 A * 6/1988 Nagabhushan ..... 89/1.51
4,754,706 A * 7/1988 Fauvel et al. ..... 102/489
4,913,054 A * 4/1990 Petersen ..... 102/439
H000941 H * 8/1991 Wyluda ..... 102/522
5,255,608 A * 10/1993 Min et al. ..... 102/215
5,295,439 A * 3/1994 Carbone ..... 102/438
5,427,032 A * 6/1995 Hiltz et al. ..... 102/336

(Continued)

FOREIGN PATENT DOCUMENTS

CH 623130 A5 5/1981

(Continued)

*Primary Examiner*—Teri Pham Luu
*Assistant Examiner*—Bret Hayes
(74) *Attorney, Agent, or Firm*—Connolly Bove Lodge & Hutz LLP

(57) ABSTRACT

An ammunition device (4) comprising one or more warhead effect jackets (17), each jacket containing warhead effect elements (18). The ammunition device also incorporates one or more explosive compositions arranged inside each warhead effect jacket that in or close to the target is/are triggerable by means of a triggering device. One or more separation charges is/are arranged adjacent to each warhead effect jacket that when actuated cause removel of one or more said warhead effect jacket(s). The actuation devices incorporate or interact with a programming device that operates with a first mode that can be an initial mode in which the actuation devices remain non-actuated, and a second mode in which the programming device actuates the actuation devices for initiating the separation charges, thereby causing ejection of each warhead effect jacket concerned.

21 Claims, 9 Drawing Sheets

Figure 1:
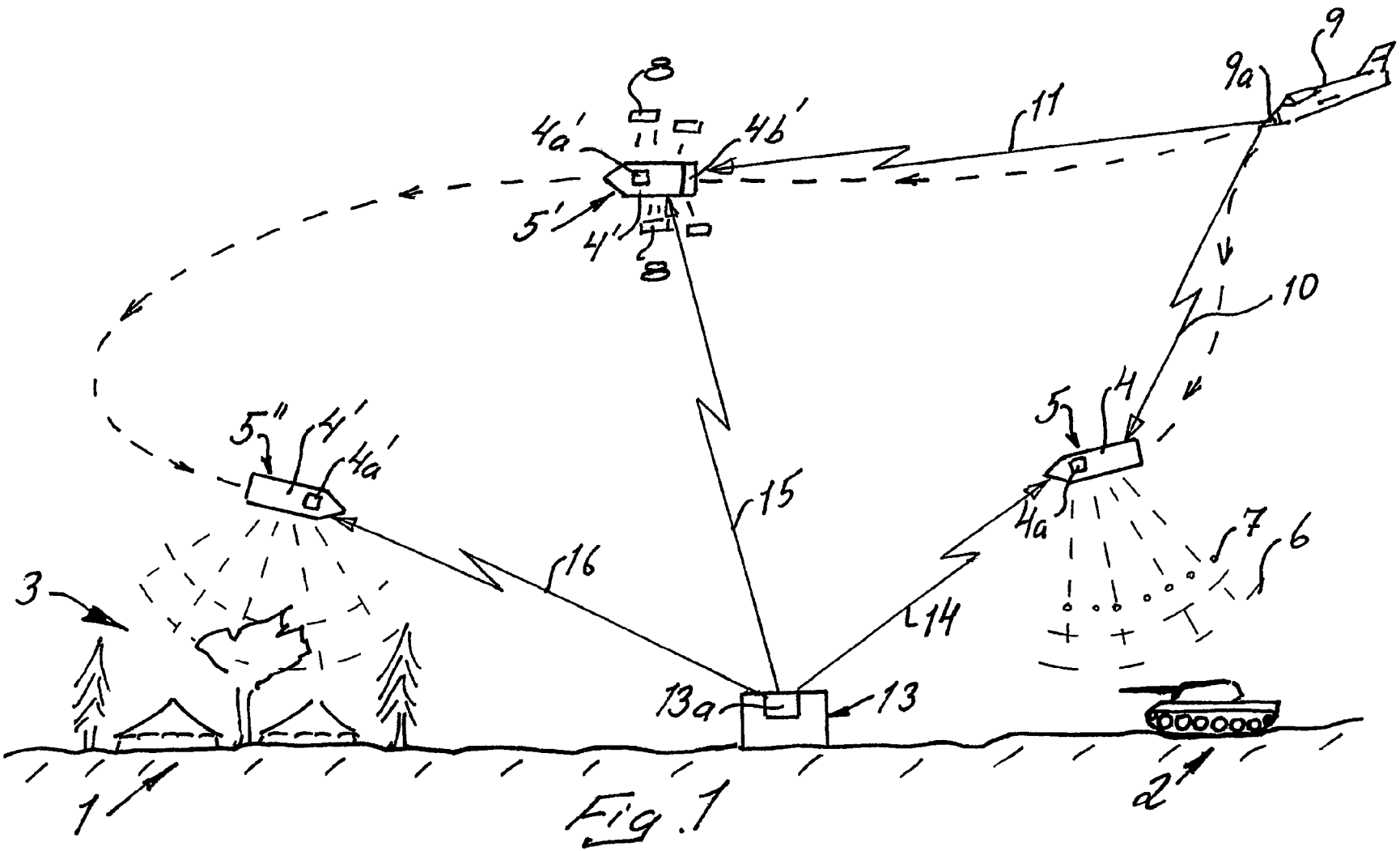

U.S. PATENT DOCUMENTS 5,528,990 A * 6/1996 Corzine et al. ..... 102/514
5,535,679 A * 7/1996 Craddock ..... 102/494
5,544,589 A 8/1996 Held
5,594,197 A 1/1997 Lindstadt et al.
5,691,502 A * 11/1997 Craddock et al. ..... 102/494
5,698,814 A * 12/1997 Parsons et al. ..... 102/478
5,864,086 A * 1/1999 Ettmuller ..... 102/489
6,640,723 B2 * 11/2003 Spivak et al. ..... 102/483
2001/0045883 A1 * 11/2001 Holdaway et al. ..... 340/5.51

FOREIGN PATENT DOCUMENTS

DE 3703773 A1 8/1988

* cited by examiner

UNIT OF AMMUNITION WITH ONE OR MORE WARHEAD CASINGS

The present invention relates to an ammunition device with one or more warhead effect jackets in the form of pellets or fragments for example. Alternatively, other types of warhead elements, such as incendiary, and/or fire sustaining agents and suchlike, can be incorporated. The ammunition device is also of the type comprising explosive compositions that can be of already known type, arranged inside each warhead effect jacket, and that can be triggered by a triggering device that can also be of an already known type. Examples of such ammunition devices are shells, missiles, cruise missiles and suchlike. The ammunition device can also be carried by a weapon platform like an aircraft, for example. The triggering device can be controllable via a wireless link from the ground or an aircraft, and may possibly comprise already known time circuits. The ammunition device can be fired from the ground or from the weapon platform of the ammunition device.

It is already known how to arrange ammunition devices with warhead effect jackets around interior explosive compositions to achieve an ammunition device of a first type suitable for combating a first target type of, for example, soft character such as a military contingent or other dispersed target that is to be attacked with fragmentation effect and/or pellets. It is also known how to exploit an explosive composition or propelling charge without a warhead effect jacket whereby one achieves an ammunition device of a second type suitable against targets that shall be subjected to blast effect such as bridges, buildings, etc.

In some engagement situations there is even a need for a delay option regarding type of ammunition effect owing to the fact that when the ammunition device is fired or launched from the ground or an aircraft the type of target or the desired in target effect has not been determined. It shall thus be possible to finally determine the type of ammunition effect while the ammunition device or aircraft is in the air and is, for example, circling over the target or different types of target. Known technology involves carrying ammunition devices of both types, despite which there is a risk of firing the wrong type of ammunition at the target in question. The present invention makes it possible to decide at a late stage which ammunition warhead effect (e.g. fragmentation combined with blast) shall be used to combat the target.

There is thus a need to be able to enhance the effectiveness of engagements while simultaneously reducing the vast assortment of ammunition devices. The objective of the present invention, among other things, is to resolve these problems, and to propose that ammunition devices shall be arranged with warhead effect jackets that can be ejected before target approach or release, i.e. adaptation of the ammunition device shall be possible during approach or while the ammunition cargo device or its weapon platform is circling over the target zone. It is thus vital that target optimised, safe ejection functions are employed for the warhead effect jackets to maintain the effectiveness of the ammunition device. It is also essential that the ammunition device can function with a high degree of safety during handling and servicing on the ground, and when loading the ammunition device or devices into/onto a possible weapon platform. There is also a desire to be able to use the ammunition device in several different ways. The present invention is intended to resolve this problem too.

The main characteristic features of the ammunition device disclosed initially are, among other things, that adjacent to each warhead effect jacket there is arranged one or more separation charges each of which when actuated by dedicated actuation devices causes the removal of one or more warhead effect jackets, and that the actuation devices incorporate or interact with a programming device that operates with a first mode, i.e. an initial programming mode, in which the actuation devices remain non-actuated, and a second programming mode in which the programming device actuates the actuation devices for initiating the separation charge or charges for ejection of each warhead effect jacket concerned.

The design forms of the invention concept involve, among other things, that the programming device shall be arranged on the ground or on board the weapon platform for the ammunition device such as an aircraft. In the said design forms each warhead effect jacket shall incorporate incipient fractures or weakened sections or surfaces via which the jacket shall rupture on actuation of the separation charge or charges. Specific designs can thus be used for the jackets and propelling charges, and thereby the jackets and propelling charges can assume different cross-sectional forms in which the jacket or jackets have a hexagonal form and the propelling charge a circular form, or vice versa. Depending on the cross-sectional forms of the warhead effect jacket and the propelling charge respectively, the separation charge or charges can be assigned different geometrical shapes in cross-section. Consequently, the separation charges can be sector-shaped, wafer-shaped, etc in cross-section. The separation charges can also be arranged in parts of the warhead effect jacket and, for example, be evenly distributed around the cross-section of the jacket to achieve the appropriate rupture functions. In one design form only part of the warhead effect jacket is removed enabling fragmentation effect in selected sectors only. This is an advantage if the target is close to something (such as an object, troops, civilians, etc) that one does not want to damage/injure by fragmentation effect. In other design variants the ammunition device can be equipped with a number of concentric warhead effect jackets with separation charges located in between. The jackets can comprise large and small fragments or light and heavy pellets for example. The warhead can also be arranged to provide a burst with all the warhead effect jackets still in place providing effect at long stand-off with large fragments, and effect at short stand-off with small fragments at high density per unit area. If the warhead effect jacket with large fragments has been removed when the warhead bursts, effect is obtained from the small fragments. The effect radius of the warhead can thereby be restricted. When all the warhead effect jackets have been removed from the warhead, only blast effect remains. The effect radius is then small in relation to the effect radius with fragmentation. In this way three levels of warhead effect can be selected with various effect radii according to target type. Additional variants of the present invention are disclosed in the subsequent Patent Claims and the detailed description.

The above proposals provide an ammunition device that is advantageous from a technical-financial aspect, and which can be adapted to various target types in conjunction with approach and initiation at the target. Engagement in the various target situations can thus be achieved by using in principle the same ammunition device, which is actuatable to the programming mode appropriate for the various types of target. Well proven components can be used in this context, which guarantees retention of a high degree of safety during handling and servicing of the ammunition devices. The ammunition devices can be applied, for example, on aircraft, in missiles (such as cruise missiles), artillery shells, etc that circle or fly over a target zone where there are different types of targets. In conjunction with its firing/launch the ammunition device can be finally programmed to the right mode for the target type, which will subsequently be combated effectively. Already known separation charges can be employed. Thus it can be determined at a late stage whether the ammunition device is to engage a target in question with blast effect only, or whether fragmentation, pellets, etc shall be included in the effect triggered.

Figure 6:
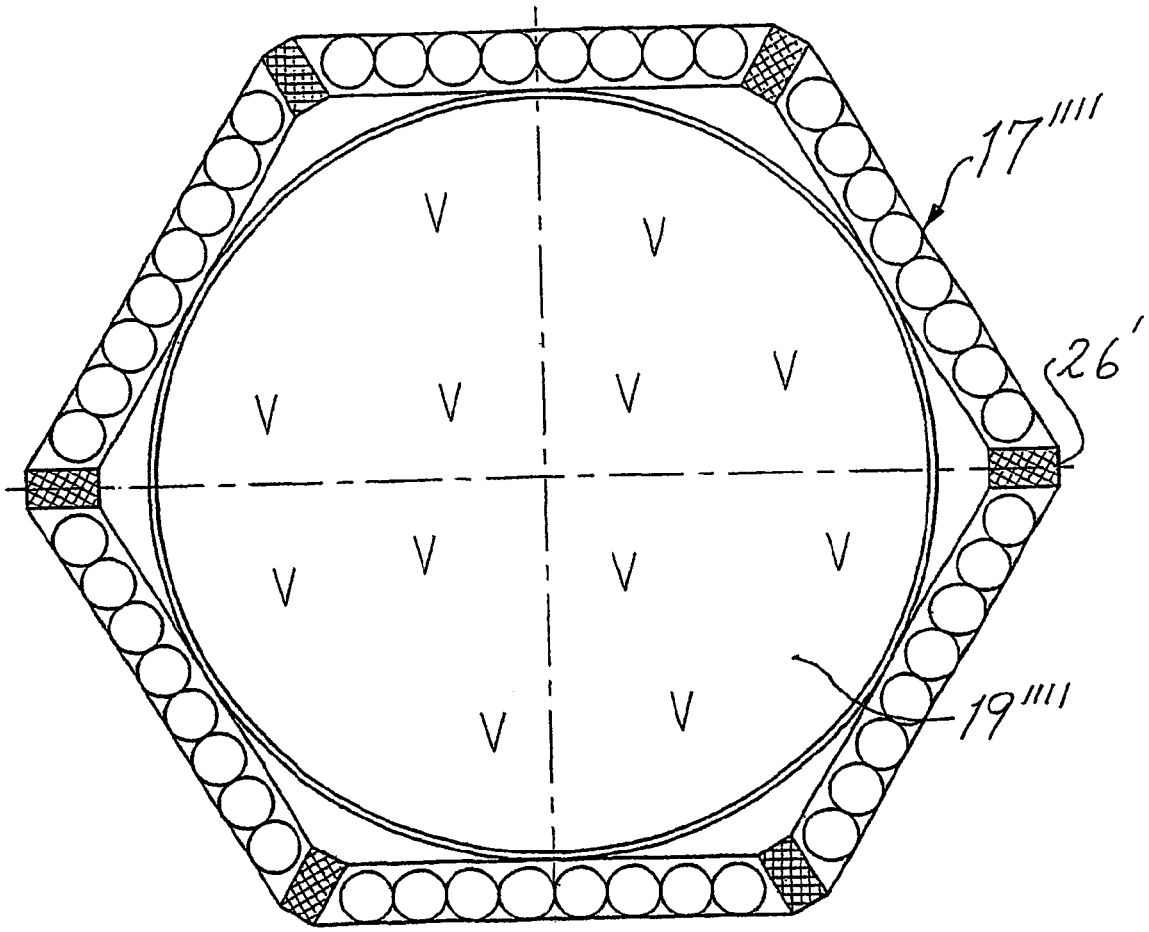
Figure 7:
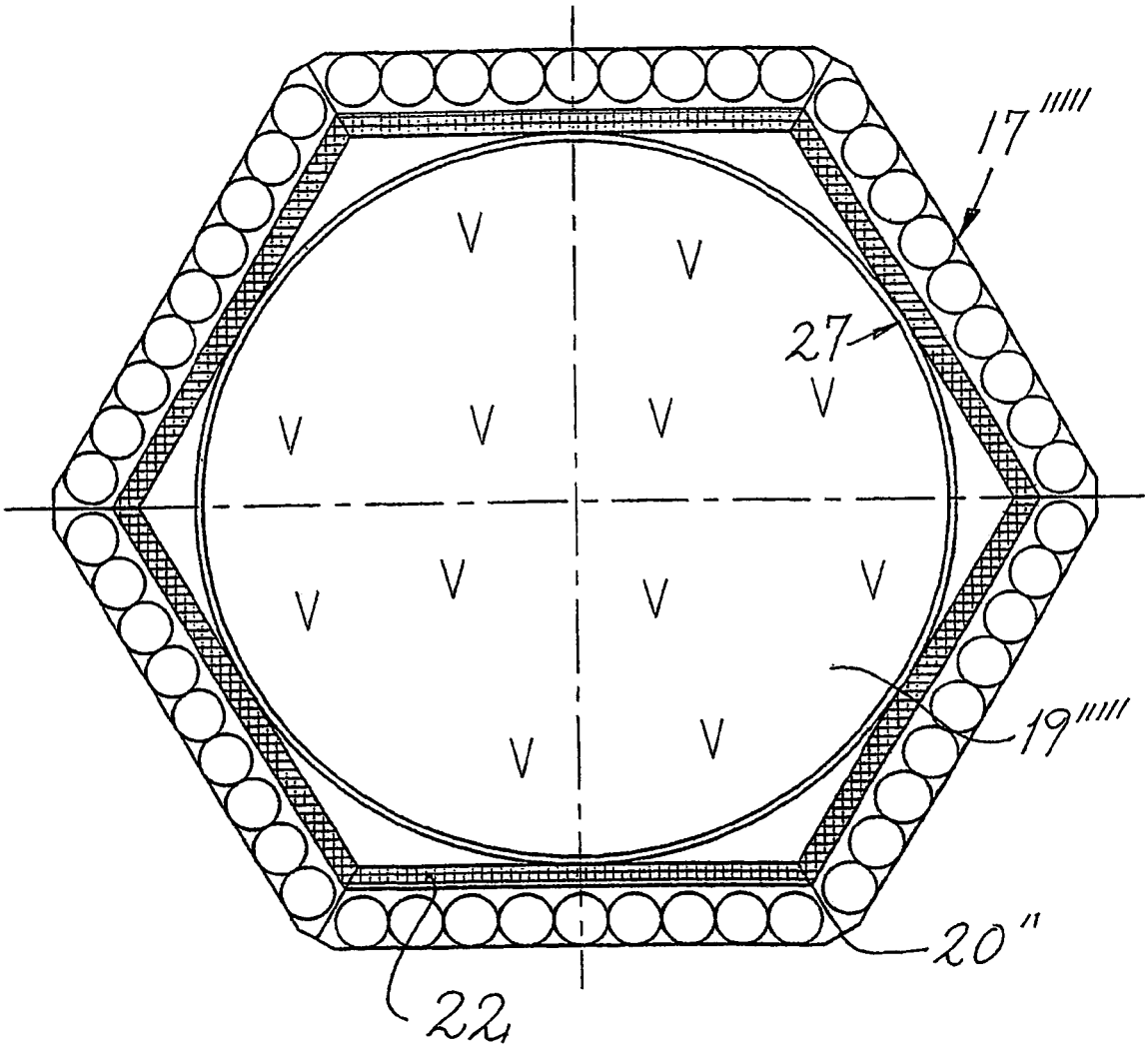
Figure 8:
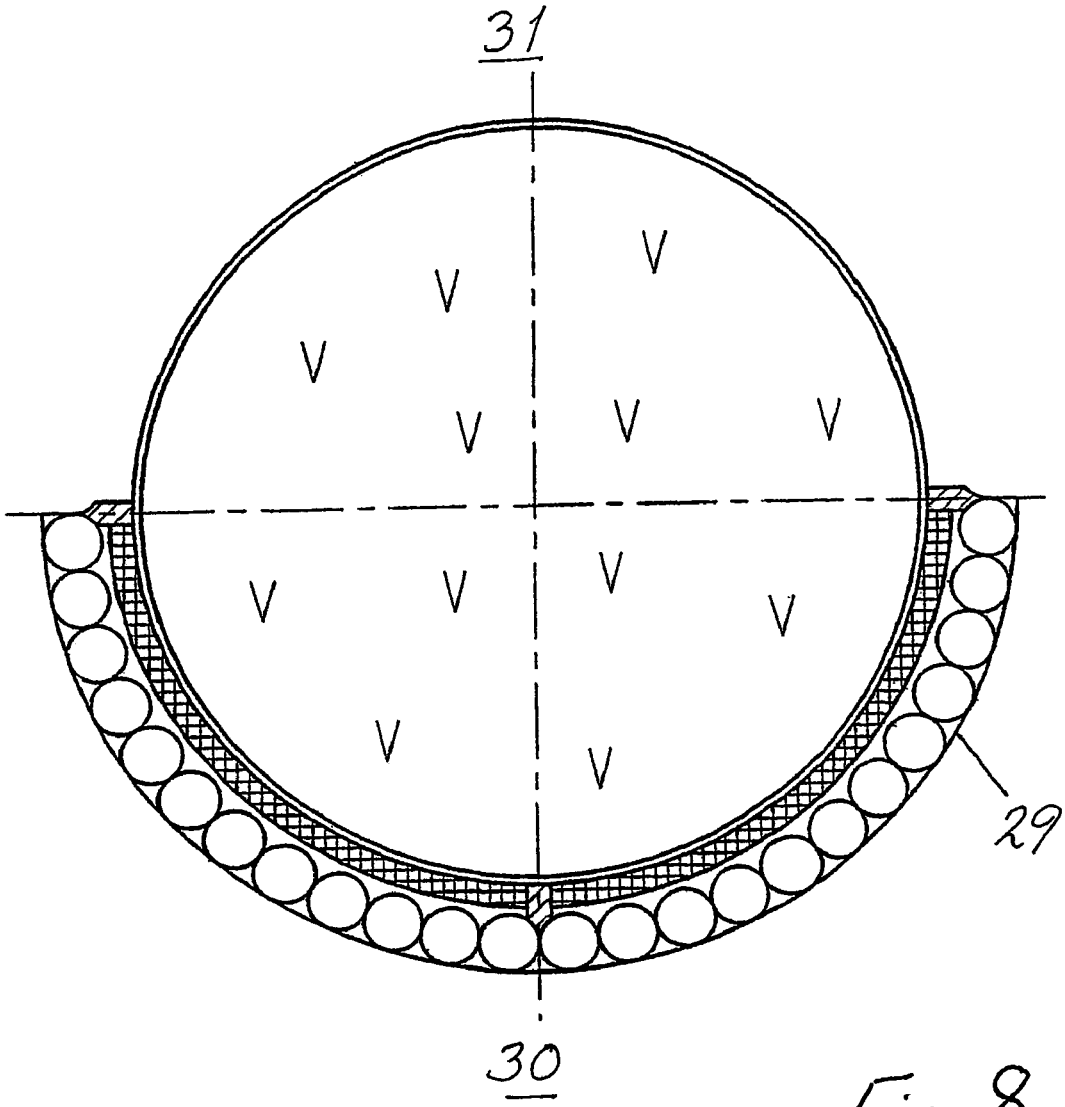
Figure 9:
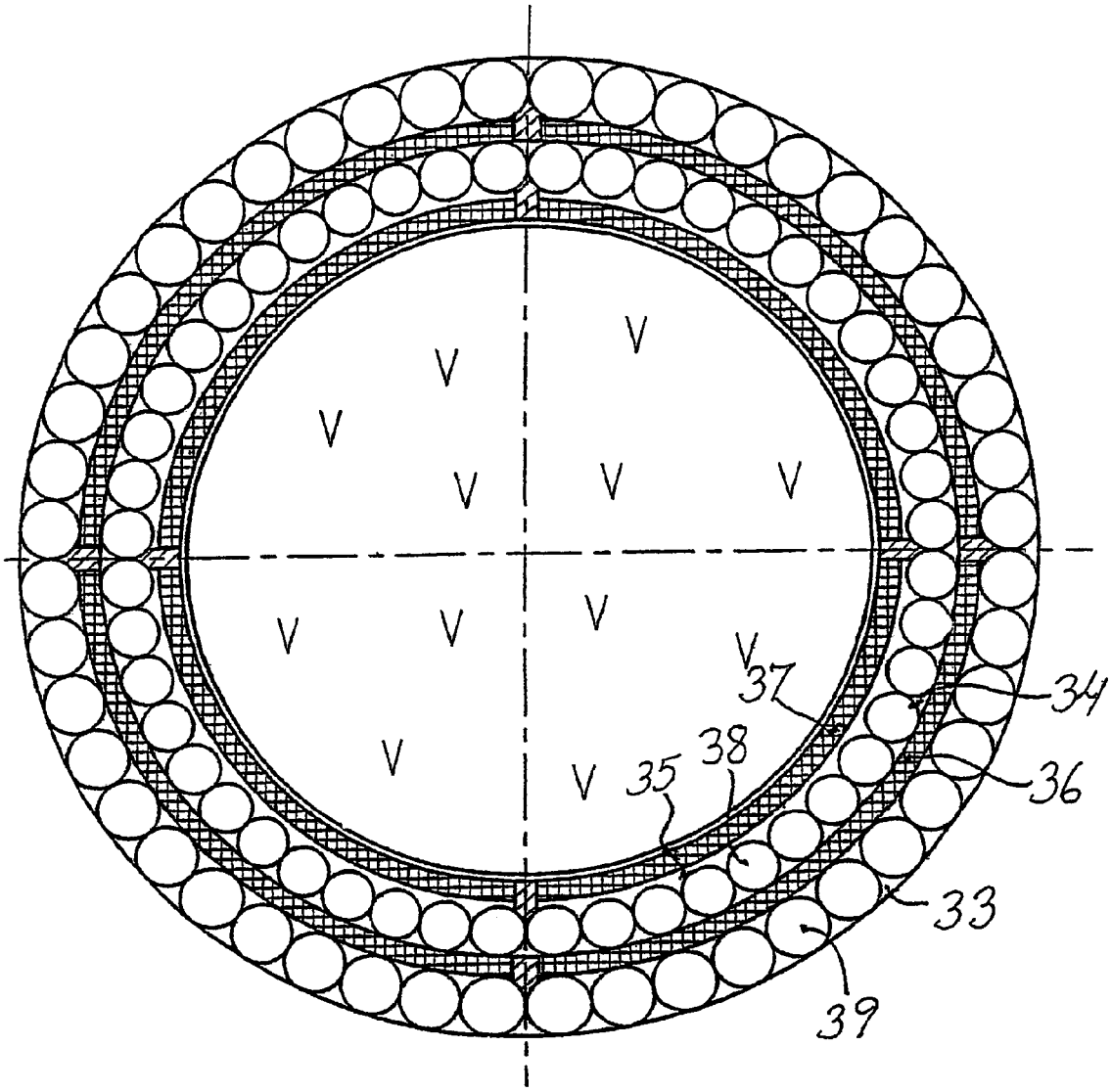

A currently proposed design for a device displaying the significant features of the presently claimed invention is described below with reference to the appended FIGS. 1–9 in which FIG. 1 shows an overview of different types of targets, different warhead functions when actuated, and the actuation of the ammunition device from an aircraft and/or from the ground, FIGS. 2–7 show cross-sections of variants of the warhead effect jacket and the separation charges arranged inside the jacket, while FIG. 8 shows a cross-section of another variant that provides fragmentation effect in selected sectors only, and FIG. 9 shows a cross-section of yet another variant that provides a triple-level function regarding warhead functions.

FIG. 1 illustrates different target types 1 and 2 in a target zone 3. As claimed in the present invention, engagement of each target type shall be enabled in an optimal manner with one and the same type of ammunition device. Alternatively, it shall be possible to engage one of the said targets 1 or 2 with various warhead effects that shall be selectable at a late stage during the engagement in question. FIG. 1 shows an ammunition device 4 illustrated in a first position 5. In position 5 the ammunition device 4 is above the target type 2 and, as illustrated in the example, the said ammunition device is engaging target 2 with a warhead effect providing blast effect 6 combined with fragmentation or pellets 7. The ammunition device 4 can carry out an alternative action, for example against target 1. In this alternative action the ammunition device operates in two stages whereby in the first stage the ammunition device is designated 4' and is in position 5'. In this stage the separation charges described in more detail below have been actuated involving ejection of warhead effect jacket 8, as also described below. After ejection the ammunition device 4' can assume position 5" closer to target 1. In position 5" target 1 is engaged using only blast effect 6'. It is considered that this alternative effect can also be applied against target 2. The ammunition device 4 can be of an already known type carried by an aircraft 9. In the case illustrated with 4 and 5 aircraft 9 launches ammunition device 4 against target 2. The ammunition device is equipped with time circuits 4*a* that in an already known manner can be triggered either from the aircraft, missile, etc via a wireless link 10, or by time circuits that are started at launch/release from the aircraft 9 or equivalent. The ammunition device also incorporates actuation devices 4*b'* for the separation charges described below.

Alternatively, the aircraft (or equivalent) can launch the ammunition device 4' as illustrated in positions 5' and 5". After launch from the aircraft (or equivalent) the programming device 9*a* in the aircraft is actuated to enable it—via a wireless link 11—to trigger the said separation charges symbolised by 4*b'*. At this stage the actuation device for the propelling charge or charges of the ammunition device has not been actuated. Actuation of separation charges 4*b'* results in separation of the warhead effect jacket or jackets 8 from the body of the ammunition device 4'. Already known time circuits can constitute an alternative to a triggering signal or programming signal from the programming device 9*a* on board the said aircraft, which circuits can be actuated in conjunction with launch from the aircraft 9 (or equivalent) to trigger the said separation charges when the ammunition device 4' is at a safe distance from the aircraft. After separation of the warhead effect jacket(s) in this way the ammunition device 4' can continue on its approach to the target 1' until reaching position 5" where the explosive charge is triggered by the devices 4*a'* that can be actuated via a wireless link 12, or by time circuits started at launch from the aircraft 9. Consequently, only blast pressure effect (without fragmentation, pellets, etc) is triggered against target 1. According to the above the ammunition device can alternatively be of a type that is fired from the ground, such as a missile or cruise missile, whereby the said programming device is arranged in ground-based equipment 13, which thus includes a device equivalent to the said programming device 9*a*. Ground-based equipment actuates the ammunition device via wireless links 14, 15 and 16.

Figure 2:
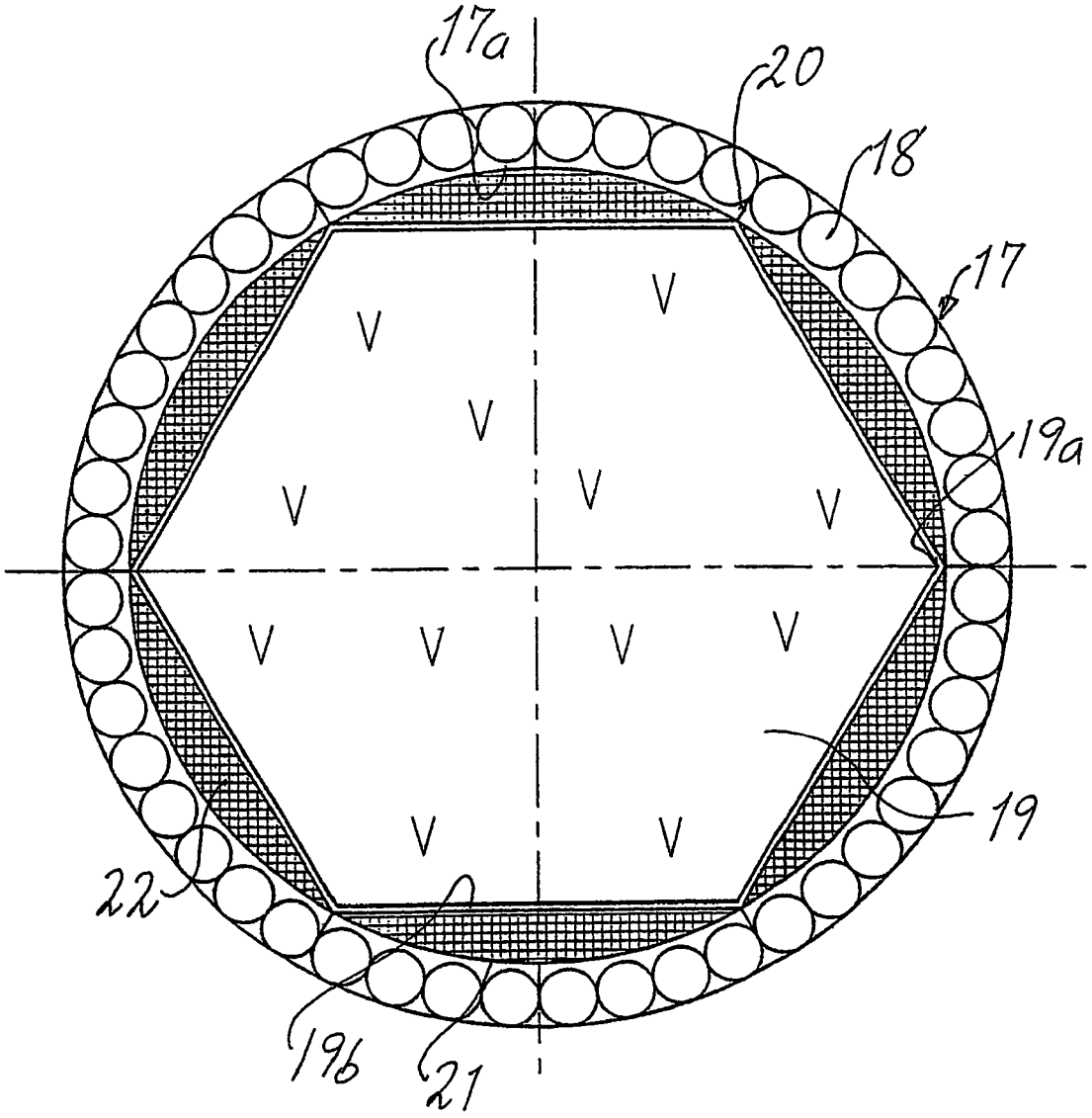

FIG. 2 shows a warhead effect jacket designated 17 incorporating effect elements in the form of pellets designated 18. An explosive composition 19 is arranged internally or inside the jacket. In accordance with the variant illustrated the warhead effect jacket is essentially circular in form in the cross-section shown in FIG. 2. The explosive charge 19 in the same cross-section has the form of a polygon which, in the design example illustrated, is a hexagon. Warhead effect jacket 17 incorporates incipient fractures or weakened surfaces or parts 20 that facilitate rupture of the jacket when it shall be ejected prior to triggering of the explosive charge 19. The corners 19*a* of the hexagonal explosive charge 19 are adjacent to the inner surface 17*a* of the warhead effect jacket. The points of connection for corners 19*a* are thereby arranged adjacent to the said incipient fractures 20. The said forms of the warhead effect jacket and explosive charge result in sector-shaped spaces 21 between the sector faces 19*b* of the explosive charge and the said inner surfaces 17*a* of the warhead effect jacket, in which spaces the separation charges 22 are located. The latter are of already known type, and are triggered by the above stated devices 4*b* using an already known method. When actuated the separation charges shall not cause triggering of the explosive charge 19 as this shall be triggered at a later stage.

Figure 3:
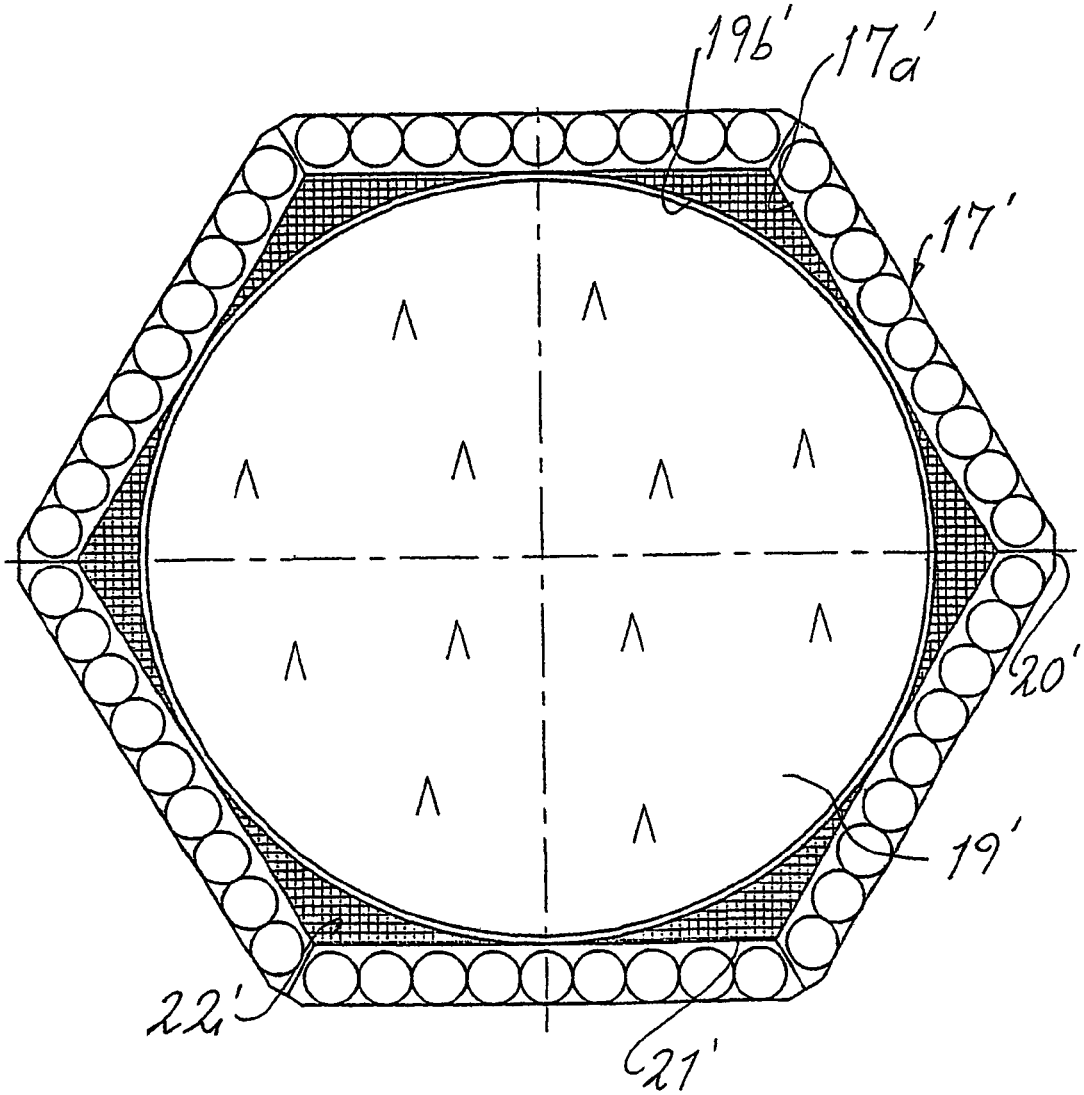

In the variant illustrated in FIG. 3 the warhead effect jacket 17' is instead shaped like a polygon which, in the design example, is a hexagon. The explosive charge 19' has a circular design in the cross-section shown. The spaces thus obtained between the inner surfaces 17*a* and the outer face 19*b'* of the explosive charge have an essentially triangular shape in which the base of the triangle is curved in accordance with the circular outer surface of the explosive charge. The apexes 22*a* of the triangles are thereby arranged adjacent to the above mentioned incipient fractures or weakened surfaces or parts 20'. Even in this case actuation of the separation charges will effectively rupture the warhead effect jacket without triggering the explosive charge 19'. Naturally the explosive charges 19 and 19' are thereby arranged to be retained in the ammunition device after separation of the warhead effect jacket.

Figure 4:
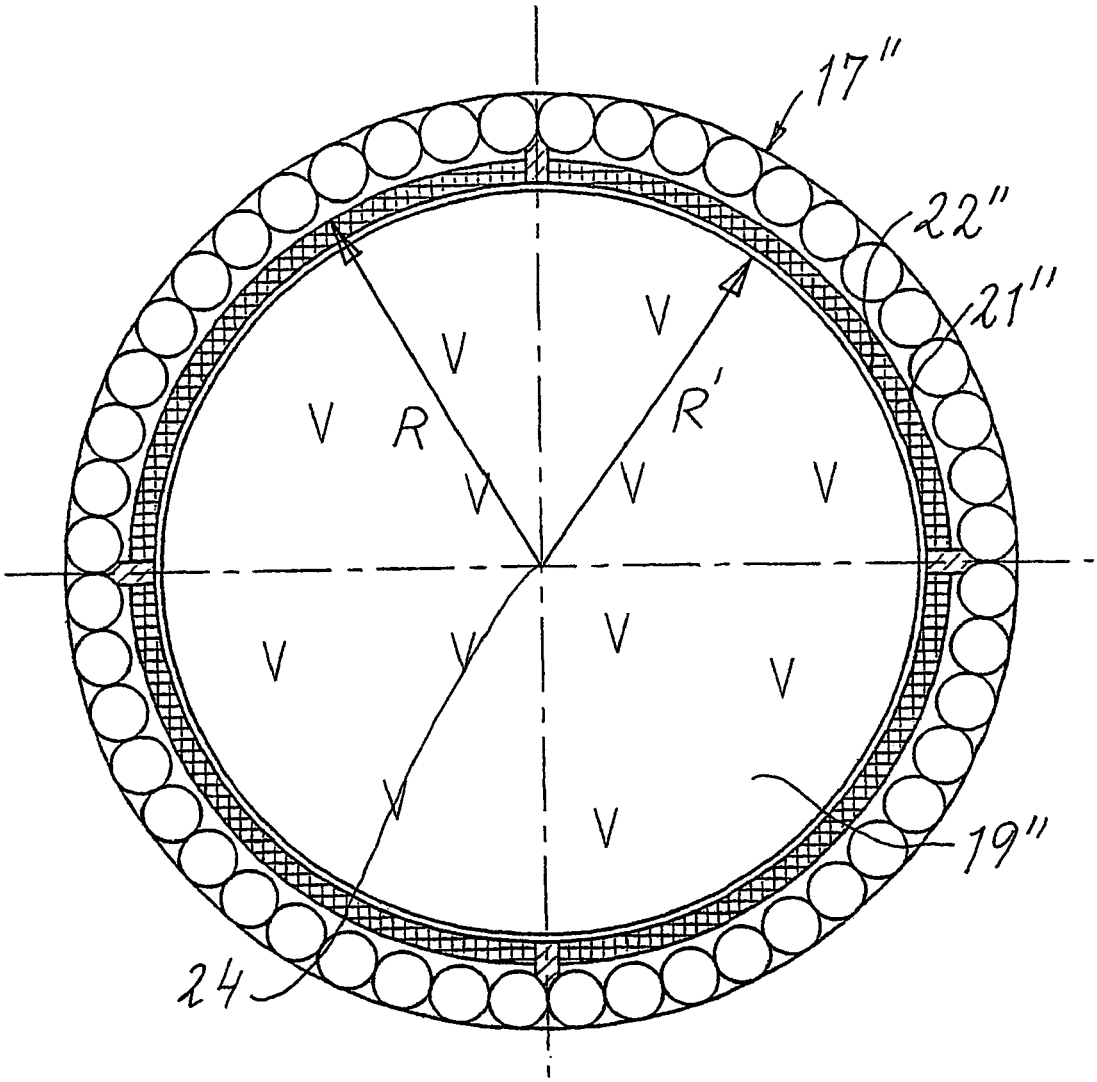

In the variant illustrated in FIG. 4 both the warhead effect jacket 17" and the explosive charge 19" are designed with circular cross-sections. The warhead effect jacket 17" has a radius R that exceeds radius R' of the outer surface of the explosive charge. A ring-shaped space is thereby formed in which a similarly ring-shaped separation charge 22" is arranged. This variant employs a number of wedge-shaped devices 23 extending from separation charge 22' to positions between two adjacent pellets 18' and 18". The wedge-shaped devices 23 are evenly distributed around the circumference of the warhead effect jacket, and in the case illustrated are four in number. The said wedge-shaped devices endeavour to divide the jacket into four essentially equally large pieces, of which one is designated 17*c,* in a radial direction outwards from the centre 24. Each piece 17*c* constitutes a quarter of the circumference of the jacket.

Figure 5:
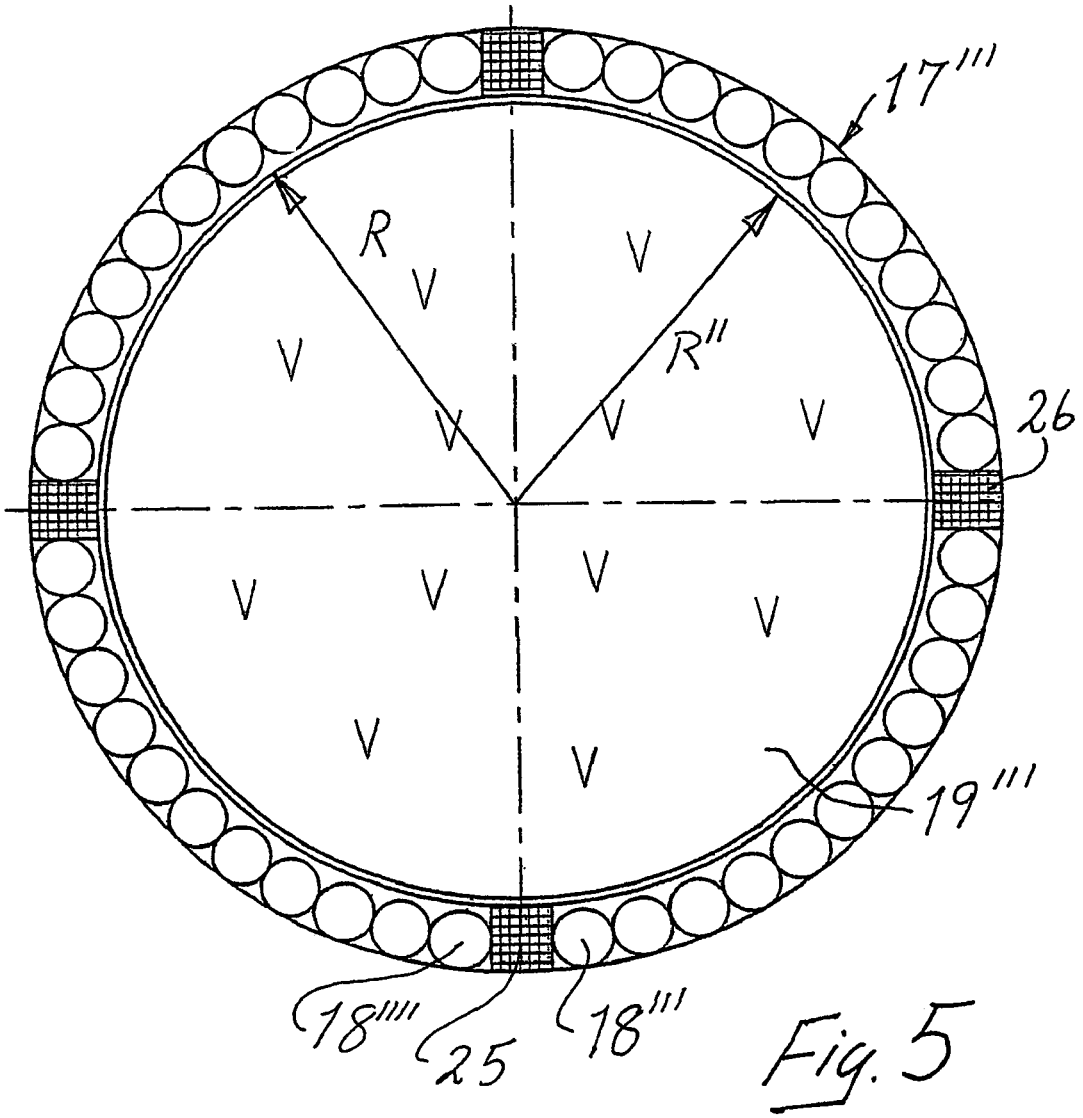

The variant illustrated in FIG. 5 also has circular cross-sections for the warhead effect jacket 17'" and the explosive charge 19'". In this case the difference is that the radius R for the inner surface of the jacket only slightly exceeds the radius R" of the outer surface of the explosive charge 19'". The separation charge in this case is divided into four smaller separation charges 25, 26, 27 and 28 arranged in the jacket, and in this case inside the pellets chamber such that each separation charge is located between two consecutive pellets, e.g. separation charge 25 is located between pellets 18'" and 18"". The current case employs four separation charges evenly distributed around the circumference of the jacket arranged at a mutual distance of 90°, i.e. in principle the jacket is divided into four essentially equally large pieces that are separable from the explosive charge 19'" in conjunction with actuation or triggering of the separation charges.

In the variant illustrated in FIG. 6 the separation charges 26' are distributed in a similar manner to that shown in the variant in FIG. 5. In the variant shown in FIG. 6 the warhead effect jacket 17"" has a hexagonal design as shown in the cross-section illustrated. There are six separation charges 26' with one located at each corner of the hexagon. The warhead effect jacket is thereby divided into six separable pieces that are effectively separated from the explosive charge 19"" when the said separation charges are actuated. The explosive charge 19"" has a circular shape in the design example illustrated.

The warhead effect jacket 17"'' in the design example illustrated in FIG. 7 is also hexagonal in cross-section. The explosive charge 19"'' is circular and the separation charges 22'" are generally wafer-shaped, each separation charge extending between two consecutive corners of the hexagon that incorporates incipient fractures or weakenings 20" as described above. The said circular explosive charge holds the separation charges 22'" in place by interacting with the centres of the wafer-shaped separation charges.

As shown in FIG. 8 only one piece of the warhead effect jacket can be removed, and in this example half the jacket has been removed or ejected so that only the other half 29 of the warhead effect jacket remains or is incorporated in the actuation of the ammunition device. The initiated sector 30 of the piece 29 of the warhead effect jacket in question causes fragmentation effect, while sector 31 causes only blast effect (without fragmentation owing to the piece of warhead effect jacket that is absent in FIG. 8).

In the variant illustrated in FIG. 9 the ammunition device 32 incorporates several concentric warhead effect jackets 33 and 35 with tubular separation charges 36 and 37. The various warhead effect jackets can comprise small and large fragmentation elements 38 and 39 respectively. FIG. 9 illustrates different layers of warhead effect jackets, and it is considered that the number of layers is variable. If all the warhead fragmentation layers are in place when the ammunition device 32 is triggered, the large fragmentation elements provide effect over a long stand-off distance while the small fragmentation elements provide effect over a short stand-off distance, and the latter also provide a high density of fragmentation elements per unit of area. If the warhead effect jacket with the large fragmentation elements is removed/ejected before the ammunition device is triggered, effect is provided by the small fragmentation elements and the effect radius of the warhead is thus limited when the ammunition device is triggered. If both or all the warhead effect jackets are removed/ejected before the ammunition device is triggered it can provide only blast effect, which means that the said ammunition device can provide different levels of effect depending on the number of concentric warhead effect jackets present when the device is triggered.

The present invention is not limited to the design examples illustrated above, but can be subjected to modifications within the framework of the subsequent Patent Claims and the invention concept.

We claim:

1. An ammunition device comprising:

at least one warhead effect jacket comprising warhead effect elements in the form of pellets or fragmentation elements;

at least one explosive composition arranged inside of said at least one warhead effect jacket;

at least one triggering device arranged to actuate said at least one explosive composition when said ammunition device is close to a target;

at least one separation charge; and at least one actuation device for actuating said at least one separation charge, wherein said at least one separation charge is arranged adjacent to said at least one warhead effect jacket and is arranged to cause removal of said at least one warhead effect jacket when actuated by said at least one actuation device, wherein said actuation device is arranged to interact with a programming device to enable operation in a first mode in which said at least one actuation device remains non-actuated and a second mode in which the at least one actuation device is actuated in order to trigger the at least one separation charge for ejection of the at least one warhead effect jacket, and wherein said ammunition device provides different selectable ammunition effects through ejection or retention of said at least one warhead effect jacket.

2. An ammunition device as claimed in claim 1 wherein said at least one warhead effect jacket is fabricated with incipient fractures or weakened surfaces or parts via which said at least one warhead effect jacket ruptures when said at least one separation charge is actuated.

3. An ammunition device as claimed in claim 2 wherein the at least one warhead effect jacket has an essentially circular cross-section, that the explosive composition is designed with a cross-section having the shape of a polygon in which corners of the polygon are arranged adjacent to an inner surface of said at least one warhead effect jacket, and wherein sector-shaped spaces between an outside of the at least one explosive composition and the inner surface of the at least one warhead effect jacket contain the at least one separation charge.

4. An ammunition device as claimed in claim 2 wherein said at least one warhead effect jacket has a cross-section in the form of a polygon, wherein the at least one explosive composition is designed wit an essentially circular cross-section, and wherein a space is arranged between an outer surface of the at least one explosive composition and the inner surface of the at least one warhead effect jacket to house the at least one separation charges.

5. An ammunition device as claimed in claim 1 wherein said at least one warhead effect jacket is designed with an essentially circular cross-section, wherein the at least one explosive composition is designed with a cross-section having the shape of a polygon in which corners of the polygon are arranged adjacent to an inner surface of said at least one warhead effect jacket, and wherein sector-shaped spaces between an outside of the at least one explosive composition and the inner surface of the at least one waitead effect jacket contain the at least one separation charge.

6. An ammunition device as claimed in claim 5 wherein the corners of die polygon are located at said incipient fractures or weakened surfaces or parts.

7. An ammunition device as claimed in claim 1 wherein said at least one warhead effect jacket has a cross-section in the form of a polygon, wherein the at least one explosive composition is designed with an essentially circular cross-section, and wherein a space is arranged between an outer surface of the at least one explosive composition arid the inner surface of the at least one warhead effect jacket to house the at least one separation charge.

8. An ammunition device as claimed in claim 7 wherein said at least one warhead effect jacket has a cross-section in the form of a hexagon, and wherein said incipient fractures or weakened surfaces or parts are located at corners of the hexagon.

9. An ammunition device as claimed in claim 1 wherein the at least one explosive composition and the at least one warhead effect jacket have concentric essentially circular cross-sections, wherein the at least one explosive composition and the at least one warhead effect jacket are arranged with an intermediate ring-shaped space, and wherein the at least one separation charge is arranged in the intermediate ring-shaped space.

10. An ammunition device as claimed in claim 9 wherein wedge-shaped devices are arranged evenly distributed around a circumference of the cross-section of the at least one warhead effect jacket, and wherein, upon initiation of the at least one separation charge, said wedge-shaped devices cause or contribute to rupture of the at least one warhead effect jacket into a number of curved pieces.

11. An ammunition device as claimed in claim 10 wherein each of said curved pieces extends a distance equivalent to approximately one-quarter of the circumference of the cross-section of the at least one warhead effect jacket.

12. An ammunition device as claimed in claim 1 wherein the at least one explosive composition and the at least one warhead effect jacket have concentric essentially circular cross-sections, wherein an outer surface of the explosive composition essentially borders on an inner surface of the at least one warhead effect jacket, and where the at least one separation charge is arranged in the at least one warhead effect jacket.

13. An ammunition device as claimed in claim 12 wherein the at least one separation charge is evenly distributed in the cross-sections of the at least one warhead effect jacket and the at least one explosive composition.

14. An ammunition device as claimed in claim 1 wherein the at least one warhead effect jacket has a polygonal cross-section and the at least one explosive composition has an essentially circular cross-section, wherein the at least one separation charge is arranged at corners of the polygon or the at least one separation charge has a cross-section of a wafer shape and extends between corners of the polygon, and wherein the polygon includes incipient fractures or is fabricated with weakened surfaces or parts to facilitate rupture of the at least one warhead effect jacket.

15. An ammunition device as claimed in claim 1 wherein only parts of the at least one warhead effect jacket are removable prior to triggering of the ammunition device to enable different warhead effects in different sectors and directions from the ammunition device when the ammunition device is triggered.

16. An ammunition device as claimed in claim 15 wherein the at least one separation charge is a tubular separation charge.

17. An ammunition device as claimed in claim 1 wherein said at least one warhead effect jacket comprises a plurality of warhead effect jackets arranged concentrically with each other, wherein the at least one separation charge comprises a plurality of separation charges, and wherein each of said separation charges is dedicated to one of said warhead effect jackets.

18. An ammunition device as claimed in claim 17 wherein the device is triggerable with all of said warhead effect jackets in place, whereby a warhead effect is available to provide effect at a larger radial stand-off distance using large fragmentation elements combined with effect over a shorter radial stand-off distance using small fragmentation elements that can also provide greater fragment density per unit area.

19. An ammunition device as claimed in claim 18 wherein the warhead effect jackets are selectively removable before the device is triggered whereby a warhead effect provided by the device is dependent on whether a warhead effect jacket having large or small fragmentation elements is removed prior to triggering of the device.

20. An ammunition device as claimed in claim 1 wherein the programming device is arranged on the ground or on board a weapon platform adapted to carry the ammunition device.

21. An ammunition device comprising:

at least one warhead effect jacket, wherein said at least one warhead effect jacket is divided into sections around a periphery of the at least one warhead effect jacket, and wherein said sections comprise warhead effect elements in the form of pellets or fragmentation elements;

at least one explosive composition arranged inside of said at least one warhead effect jacket;

at least one triggering device arranged to actuate said at least one explosive composition when said ammunition device is close to a target;

a plurality of separation charges, wherein one or more of the separation charges are allocated to each of the sections; and a plurality of actuation devices, wherein each of said actuation deviceh is arranged to actuate one of said separation charges, wherein each of said separation charges is arranged to cause removal of one of said sections when actuated by one of said actuation devices, wherein each of said actuation devices is arranged to interact with a programming device to enable independent operation of each of said actuation devices in a first, non-actuated mode and a second, actuated mode in which one or more of said separation charges are triggered for ejection of one of said sections, and wherein said at least one warhead effect jacket provides different selectable ammunition effects through ejection or retention of one or more of said sections.

* * * * *